US005411155A

United States Patent [19]

Gordon et al.

[11] Patent Number: 5,411,155

[45] Date of Patent: May 2, 1995

[54] BABY BOTTLE STORAGE COVER

[76] Inventors: Rinda M. Gordon, 10370 NW. 17th Ct., Plantation, Fla. 33322; Charles B. Gordon, 5070 N. Ocean Dr., Apt. 20C, Singer Island, Fla. 33404

[21] Appl. No.: 172,928

[22] Filed: Dec. 27, 1993

[51] Int. Cl.[6] ..... A61J 9/00; A61J 9/08

[52] U.S. Cl. ..... 215/11.1; 215/6; 215/11.3; 215/11.6; 220/521

[58] Field of Search ..... 220/521; 215/6, 11.1–11.6, 215/228

[56] References Cited

U.S. PATENT DOCUMENTS

| | | | |
|---|---|---|---|
| 2,793,776 | 5/1957 | Lipari | 215/11.1 X |
| 2,807,384 | 9/1957 | Lipari | 215/11.1 |
| 2,885,104 | 5/1959 | Greenspan | 215/11.1 X |
| 3,413,128 | 11/1968 | Steinbarth et al. | 220/521 |
| 3,627,161 | 12/1971 | Wergeland | 215/11.6 |
| 3,645,414 | 2/1972 | Barr | 215/11.1 |
| 3,746,198 | 7/1973 | Howland | 215/11.1 |
| 3,834,570 | 9/1974 | Barr | 215/11.3 |
| 3,858,738 | 1/1975 | Hurst | 215/11.6 |
| 3,998,348 | 12/1976 | Sammaritano | 215/11.3 |
| 4,678,092 | 7/1987 | Rane | 215/11.3 |
| 4,693,399 | 9/1987 | Hickman et al. | 215/235 X |
| 4,776,972 | 10/1988 | Barrett | 220/521 X |
| 4,895,264 | 1/1990 | Phlaphongphanich | 215/11.6 X |
| 4,919,983 | 4/1990 | Fremin | 428/35.7 |
| 4,944,418 | 7/1990 | Wallace | 215/11.3 X |
| 4,979,629 | 12/1990 | Askerneese | 215/11.6 X |
| 5,269,425 | 12/1993 | Gomez-Acevedo | 215/11.1 |
| 5,275,298 | 1/1994 | Holley, Jr. et al. | 215/11.1 X |

FOREIGN PATENT DOCUMENTS

| | | | |
|---|---|---|---|
| 1271249 | 7/1961 | France | 220/521 |
| 2684549 | 6/1993 | France | 215/11.3 |

*Primary Examiner*—Sue A. Weaver

[57] ABSTRACT

A nurser bottle comprises a bottle proper, a nipple, a cap for clamping the nipple to the bottle proper, and a removable cover member associated with the nipple and cap for protecting the nipple against contamination until the bottle is used for feeding. The removable cover member stores and dispenses a single measure of powdered milk sufficient for a single full bottle feeding.

10 Claims, 1 Drawing Sheet

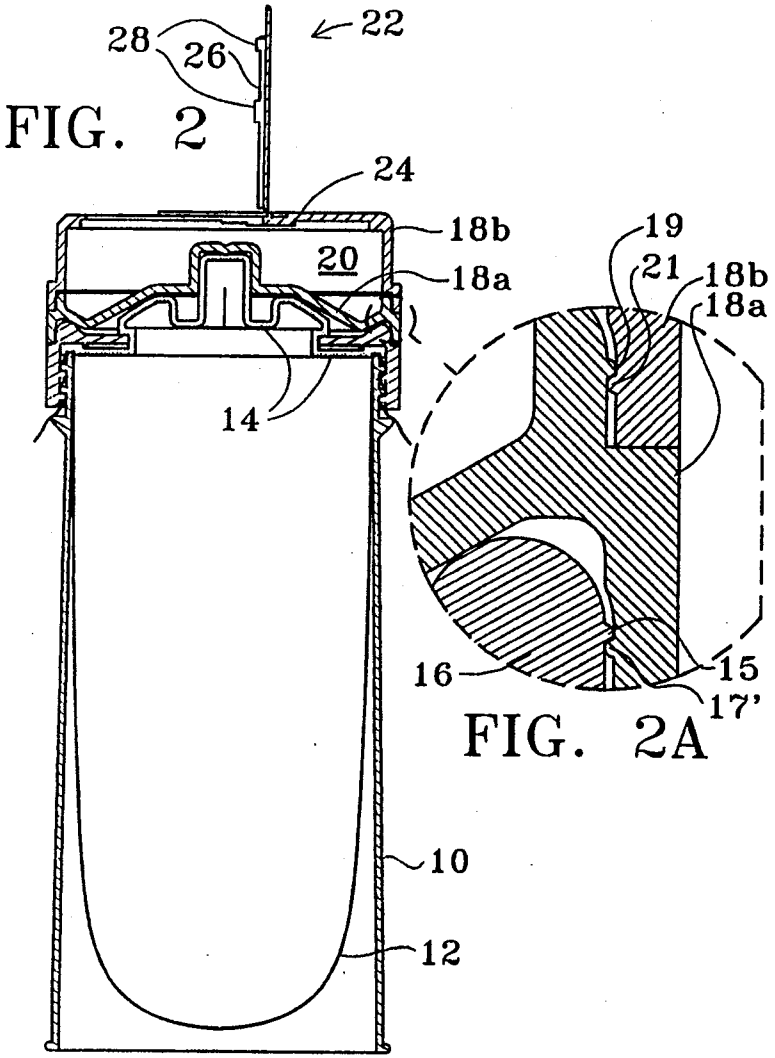
FIG. 2
FIG. 2A
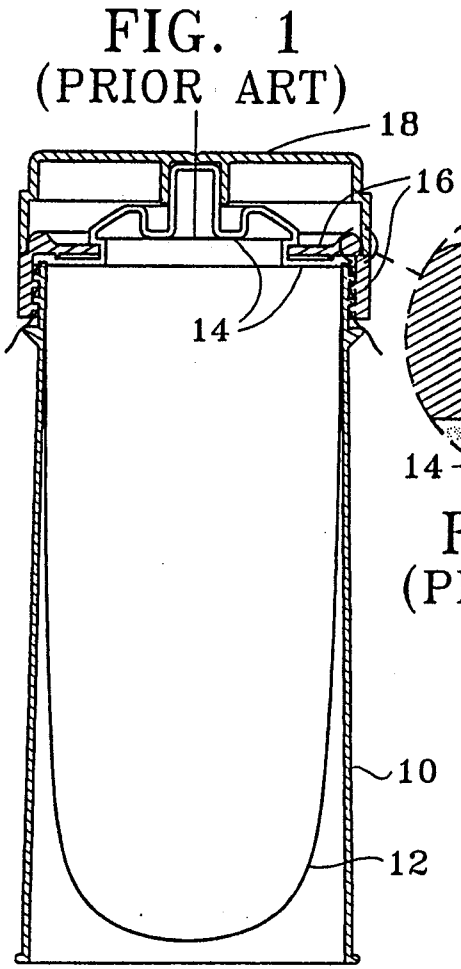
FIG. 1
(PRIOR ART)
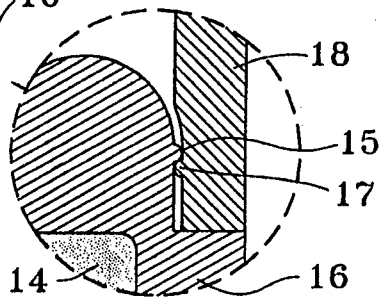
FIG. 1A
(PRIOR ART)

BABY BOTTLE STORAGE COVER

FIELD OF THE INVENTION

This invention relates to infant feeding bottles, and particularly to those of a type used with powdered milk.

BACKGROUND OF THE INVENTION

In a commonly used arrangement for bottle-feeding infants, the bottle is filled with water, to which powdered milk is added only when the baby is to be fed. That way, especially during car trips or visits away from home, or on other occasions when refrigeration may not be available for many hours at a time, the baby can be fed at any time without worrying about whether the milk has spoiled. Many hours can pass between bottle preparation and the feeding of the baby, without requiring refrigeration of the bottle. Until feeding time, the sterility or cleanliness of the nipple is protected by a removable cover.

When feeding time arrives, the nipple is removed from the bottle, a measured amount of powder is added to the water through the now-open mouth of the bottle, the nipple is reinstalled, and the bottle is shaken to mix the contents. Preferably, the protective cover for the nipple remains in covering relationship with the nipple during removal and reinstallation of the nipple, and is not removed until just before feeding.

In such arrangements, the powder is generally stored in a can or in a similar container, often with a measuring spoon or scoop supplied within the same container. The can or other container may be carried, along with one or more water-filled bottles. Just before a feeding, the scoop is used to measure the proper amount of powder to add to the bottle contents.

A can of powdered milk is somewhat heavy and bulky to carry away from home. Accordingly, smaller containers for milk powder have been provided which are washable and refillable. A known design has three chambers, each separately openable and each carrying a measure of powdered milk suitable for a single bottle. However, such a container still must be carried separate and apart from the bottles, and additional inconveniences arise when the number of bottles to be used does not match the number of storage chambers in the container, especially when the number of bottles exceed the number of storage chambers.

It is believed that no arrangement to date has provided for powder containment in direct association with each bottle on a one-for-one basis, so that the measure of powder needed for each bottle is carried along with that bottle, with no requirement for a separate powder container. The present invention provides such a device. The present invention is especially suited for bottles of the disposable flexible bag type, and is illustrated in connection therewith. However, in its broader aspects, the invention may be useful for other bottles having removable nipple covers.

BRIEF DESCRIPTION OF THE DRAWINGS

FIG. 1 is a cross-sectional view of a capped bottle of the prior art.

FIG. 1A is a detail view on an enlarged scale of a portion of FIG. 1.

FIG. 2 is a cross-sectional view of a capped bottle embodying the invention.

FIG. 2A is a detail view on an enlarged scale of a portion of FIG. 2.

DETAILED DESCRIPTION OF THE INVENTION

For readiest understanding of the invention, it is helpful to describe a prior art bottle in some detail, in order to most clearly bring out the similarities and differences between the same and the present invention.

Thus, in FIGS. 1 and 1A is shown a bottle comprising a case 10 of rigid but deformable plastic. The case 10 receives a flexible bag or envelope 12 of thin sterile plastic material. The case 10 and bag 12 together make up the bottle proper. The rim of a rubber or elastomeric nipple 14 fits over the upper end of the case 10 and is clamped in place by a threaded clamping member or cap 16 which threadedly engages the upper end of the plastic case 10. The bag is stretched over the mouth of the case 10 and is filled with water. It is clamped in place by the nipple 14 and clamping member 16. A protective cover 18 snaps in place over the clamping member 16, and is releasably fixed thereto by the interfering snap ribs 15 and 17 (FIG. 1A). If desired, the nipple 14, the protective cover 18, and the filling water may all be sterilized before use.

When the bottle is to be given to the baby, the clamping member or cap 16 is unscrewed and, along with the nipple 14 and cover 18, is removed from the case 10, a measured amount of milk powder from a separate milk container (not shown) is added to the water, and the clamping member 16 and nipple 14 are screwed back into place. The cover 18 is snapped off the clamping member 16 either before or after the latter is screwed back into place.

An example of the invention is shown in FIGS. 2 and 2A. The bottle is the same as described above, except that the protective cover 18 is replaced by a two-part cover which comprises the protective-cover-and-storage assembly **18*a*, 18*b*. Part 18*a* forms the cover base and proximal or bottom wall of the cover assembly and overlies the nipple in a relatively snug manner. Cover part 18a is releasably fixed to the clamping member or cap 16 by the snap connection provided by the interfering snap ribs 15 and 17' seen in FIG. 2B, which together form a cover-to-cap connection. Cover part 18*b* is removably fixed to cover part 18*a* by the snap connection provided by the interfering snap ribs 19 and 21, as best seen in FIG. 2B, which together form a cover-part-to-cover-part connection. Less preferably, part 18*a* may be removably fixed to part 18*b*** by a screw connection (not shown). The release force for this cover-part-to-cover-part connection is preferably higher than that of the cover-to-cap connection, so that both cover parts will tend to come away together, rather than separate from each other, when the two-part cover is removed from the cap.

The cover parts **18*a* and 18*b* together define the chamber 20 between them. Suitable dispensing means such as a hinged closable flap 22 is included in the distal or top wall 24 of the cover part 18*b*. This flap has suitable sealing means and suitable detent means for releasably holding it in closed position, and may be similar in construction to the flap 17 described in U.S. Pat. No. 4,693,399 to Hickman, whose disclosure is incorporated by reference as if repeated herein in its entirety. Thus, flap 22 may have a sealing lip 26 and catches 28 such as the like-numbered elements shown and described in Hickman. It is presently preferred that no flap corresponding to Hickman's second flap 20 is employed; instead the top wall may contain only the single flap 22**.

Other dispensing means may be used, for example the top wall of the cover part 18*b* may have formed therein the type of dispenser which is "dialed" between open and closed conditions and is commonly used on containers for grated cheeses.

Powdered milk is stored in the chamber 20 between the parts 18*a* and 18*b*. This chamber holds enough powder for one bottle. The parts 18*a* and 18*b* can remain together at all times except when taken apart for cleaning or sterilizing. The chamber 20 can be filled through the closable flap 22 or the like in the top wall of part 18*b*. Or, parts 18*a* and 18*b* can be separated, and the part 18*b* inverted, filled with powder, and then rejoined to part 18*a*.

If the dispensing opening is made large enough to allow the interior of the chamber 20 to be thoroughly washed without separation of the parts 18*a* and 18*b*, those parts may form a single component without provision for separation.

The invention makes it convenient to store and carry milk powder on a one-for-one basis, with the number of bottles being carried, and without a separate powder container.

It should be evident that this disclosure is by way of example, and that variations in addition to those mentioned above may be made by adding, modifying or eliminating details without departing from the fair scope of the teaching contained in this disclosure. For example, the invention may be employed with rigid or semirigid glass or plastic bottles rather than with the collapsible-bag type bottle illustrated, but of course adequate provision must then be made for admission of air into the bottle during feeding. The invention therefore is not limited to particular details of this disclosure except to the extent that the following claims are necessarily so limited.

I claim:

1. In a nurser bottle comprising a bottle proper, a nipple, a cap for closing the bottle proper and clamping the nipple thereto, and a removable nipple-cover member associated with the nipple and cap for covering and protecting the nipple against contamination until the bottle is used for feeding, the improvement in which the removable nipple-cover member comprises means for storing, on the exterior side of the nipple, a single measure of powdered milk sufficient for a single full bottle feeding, said nipple-cover member further comprising means for dispensing said powdered milk.

2. A bottle cap and nipple combination for an infant feeding milk bottle comprising a nipple, a threaded cap for screwing onto a bottle proper to hold the nipple thereon and close the top of the bottle, and a protective cover releasably fixed by cover-to-cap fastening means to the threaded cap for protecting the nipple prior to use, said cover being hollow and comprising wall means surrounding and defining a walled storage chamber for storing milk powder, said wall means including proximal and distal walls, said proximal wall being configured to overlie the nipple in a relatively snug manner, and said cover including a dispensing closure for said chamber.

3. A device as in claim 2 in which said dispensing closure is formed as part of said distal wall.

4. A device as in claim 2 in which said cover is formed in two parts identified respectively with said proximal and distal walls, said two parts being releasably fixed to each other by cover-part-to-cover-part fastening means.

5. A device as in claim 4 in which the release force of said cover-part-to-cover-part fastening means is higher than that of said cover-to-cap fastening means.

6. The combination of a milk container bottle proper, a nipple for the bottle, a clamping member threadedly engaging the bottle proper for clamping the nipple to the bottle proper, and a two-part protective cover removably fixed to the clamping member for protecting the nipple prior to use, first releasable interconnecting means for providing said clamp-to-cover removable fixing, said protective cover including a first part comprising a cover proper configured to overlie the nipple in a relatively snug manner and a second part comprising a storage extension overlying the first part and defining therewith a chamber for storing milk powder, said second part including dispensing means communicating with said storage chamber, said first and second parts being removably fixed to each other, and second releasable interconnecting means for providing said part-to-part removable fixing.

7. A device as in claim 6, said second part having a top wall and said dispensing means being formed in said top wall.

8. A device as in claim 7, said dispensing means being of the closable flap type.

9. A device as in claim 6, at least said second releasable interconnecting means comprising interfering snap rib means.

10. A device as in claim 6, said bottle proper comprising a relatively rigid tubular case and a disposable flexible bag, said bag being stretched over the mouth of the case and clamped in place by said nipple and clamping member.

* * * * *